US007438054B2

(12) United States Patent
Petrone et al.

(10) Patent No.: US 7,438,054 B2
(45) Date of Patent: Oct. 21, 2008

(54) FUEL INJECTOR FOR A DIRECT INJECTION INTERNAL COMBUSTION ENGINE

(75) Inventors: Michele Petrone, San Lazzaro di Savena (IT); Massimo Mattioli, Castelmaggiore (IT); Massimo Lolli, Bologna (IT); Francesco Paolo Loperfido, Bologna (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 11/782,206

(22) Filed: Jul. 24, 2007

(65) Prior Publication Data

US 2008/0022975 A1 Jan. 31, 2008

(30) Foreign Application Priority Data

Jul. 27, 2006 (EP) ..... 06425530

(51) Int. Cl.
*F02M 59/46* (2006.01)
*F02M 59/48* (2006.01)

(52) U.S. Cl. ..... 123/467; 123/490

(58) Field of Classification Search ..... 123/476, 123/468, 469, 445, 478, 472, 490, 499; 239/533.2, 239/533.8, 88–92, 585.1, 584, 583
See application file for complete search history.

(56) References Cited

U.S. PATENT DOCUMENTS 3,958,757 A * 5/1976 Happel et al. ..... 239/125
4,230,273 A * 10/1980 Claxton et al. ..... 239/125
4,869,429 A * 9/1989 Brooks et al. ..... 239/473
4,971,254 A * 11/1990 Daly et al. ..... 239/489
6,102,302 A * 8/2000 Nishimura ..... 239/96
6,698,674 B2 * 3/2004 Dantes et al. ..... 239/585.1
6,739,525 B2 * 5/2004 Dantes et al. ..... 239/533.12
6,764,031 B2 * 7/2004 Sebastian et al. ..... 239/584
6,811,105 B2 * 11/2004 Kato et al. ..... 239/533.2
7,140,556 B2 * 11/2006 Cristiani et al. ..... 239/125

FOREIGN PATENT DOCUMENTS

| | | |
|---|---|---|
| EP | 0 971 118 | 1/2000 |
| EP | 1 635 055 | 3/2006 |
| WO | 02/084109 | 10/2002 |

* cited by examiner

*Primary Examiner*—Mahmoud Gimie
(74) *Attorney, Agent, or Firm*—Baker & Daniels LLP

(57) ABSTRACT

A fuel injector comprising: an injection valve provided with a mobile needle to regulate the fuel flow; an actuator adapted to shift the needle; an injection nozzle; a supporting body having a tubular shape and displaying a feeding channel; a sealing body provided with a valve seat of injection valve and comprising a disc-shaped capping element, which lowerly and fluid-tightly closes the feeding channel and is crossed by the injection nozzle, and a guiding element, which rises from the capping element, has a tubular shape, and accommodates the needle therein; an external fuel guiding channel defined between the feeding channel and the guiding element; a number of through feeding holes obtained in the lower part of the guiding element and leading towards valve seat; and a shutter head having an essentially spherical adjustment zone, which is integral with the needle, externally engages the guiding element.

12 Claims, 2 Drawing Sheets

FUEL INJECTOR FOR A DIRECT INJECTION INTERNAL COMBUSTION ENGINE

TECHNICAL FIELD

The present invention relates to a fuel injector for a direct injection internal combustion engine.

The present invention finds advantageous application in an electromagnetic fuel injector, to which explicit reference will be made in the description below without therefore loosing in generality.

BACKGROUND ART

An electromagnetic fuel injector comprises a cylindrical tubular body displaying a central feeding channel, which functions as a fuel conduit and ends with an injection nozzle regulated by an injection valve controlled by an electromagnetic actuator. The injection valve is provided with a needle, which is rigidly connected to a mobile keeper of the electromagnetic actuator in order to be displaced by the action of the electromagnetic actuator between a closed position and an open position of the injection nozzle against the bias of a spring which tends to hold the needle in the closed position. The valve seat is defined in a sealing element, which is shaped as a disc, lowerly and fluid-tightly closes the central channel of the support body and is crossed by the injection nozzle.

Patent application EP1635055A1 describes an electromagnetic fuel injector in which a guiding element rises from the sealing element, such guiding element having a tubular shape, accommodating the needle therein in order to define a lower guide of the needle itself and displaying a smaller external diameter with respect to the internal diameter of the feeding channel of the supporting body so as to define an external annular channel through which pressurised fuel flows. Four through feeding holes, which lead towards the valve seat to allow the flow of pressurised fuel towards the valve seat itself, are obtained in the lower part of the guiding element. The needle ends with an essentially spherical shutter head, which is adapted to fluid-tightly rest against the valve seat and slidingly rests on an internal cylindrical surface of the guiding element so as to be guided in its movement. The injection nozzle is of the "multi-hole" type, i.e. it is defined by a plurality of through injection holes, which are obtained from a chamber formed downstream of the valve seat; in this way, the optimal geometries of the injection nozzle may be obtained for the various applications by appropriately orienting the single injection holes.

Experimental tests have shown that the drive time-injected fuel quantity curve (i.e. the law linking the drive time to the quantity of injected fuel) of the electromagnetic injector described above is on the whole rather linear, but displays an initial step (i.e. displays a step increase for short drive times and therefore for small quantities of injected fuel); furthermore, the extent of such initial step is higher proportionally to the fuel feeding pressure.

Consequently, the electromechanical injector described above may be used in a direct injection internal combustion Otto cycle engine (i.e. fed with petrol, LPG, methane or the like), in which the fuel feeding pressure is limited (lower than 200-250 bars) and the injector is not normally driven to inject small amounts of fuel). However, the electromagnetic injector described above cannot be used in a small direct injection internal combustion Diesel cycle engine (i.e. fed with Diesel fuel or the like), in which the feeding pressure of the fuel is rather high (up to 800-900 bars) and the injector is constantly driven so as to perform a series of pilot injectors before a main injection.

SUMMARY OF THE INVENTION

It is the object of the present invention to provide a fuel injector for a direct injection internal combustion engine, which is free from the drawbacks described above and, in particular, is easy and cost-effective to implement.

According to the present invention, a fuel injector for a direct injection internal combustion engine is provided wherein the feeding holes are dimensioned so that the intensity of a first autoclave force which is generated only when the injection valve is closed is equal to a second autoclave force which is generated only when the injection valve is opened. In one form of the invention, the feeding holes are dimensioned so as to cause, when the fuel flows therethrough towards the injection nozzle, a localized pressure drop, the intensity of which is provided by the formula:

$$\Delta P_{21}=P_c*A_1/A_2,$$

wherein $P_c$ is the fuel feeding pressure, $A_1$ is the total area of the ceiling zone of the shutter head and $A_2$ is the total area of contact zone between the shutter head and the guiding element.

In accordance with another embodiment of the invention, the feeding holes are dimensioned according to the following formula:

$$\Delta P_{24}/\Delta P_{21}=K*((D_2\hat{}2/D_1\hat{}2)-1)$$

- $\Delta P_{21}$ pressure drop determined by localised load loss the through feeding holes;
- $\Delta P_{24}$ pressure drop determined by localised load loss through the injection holes;
- $D_1$ diameter of the sealing zone of shutter head;
- $D_2$ diameter of the contact zone between the shutter head and guiding element;
- K experimental constant linked to the constructive features of the fuel injector.

BRIEF DESCRIPTION OF THE DRAWINGS

The present invention will now be described with reference to the accompanying drawings illustrating a non-limitative embodiment example, in which.

PREFERRED EMBODIMENTS OF THE INVENTION

Figure 1:
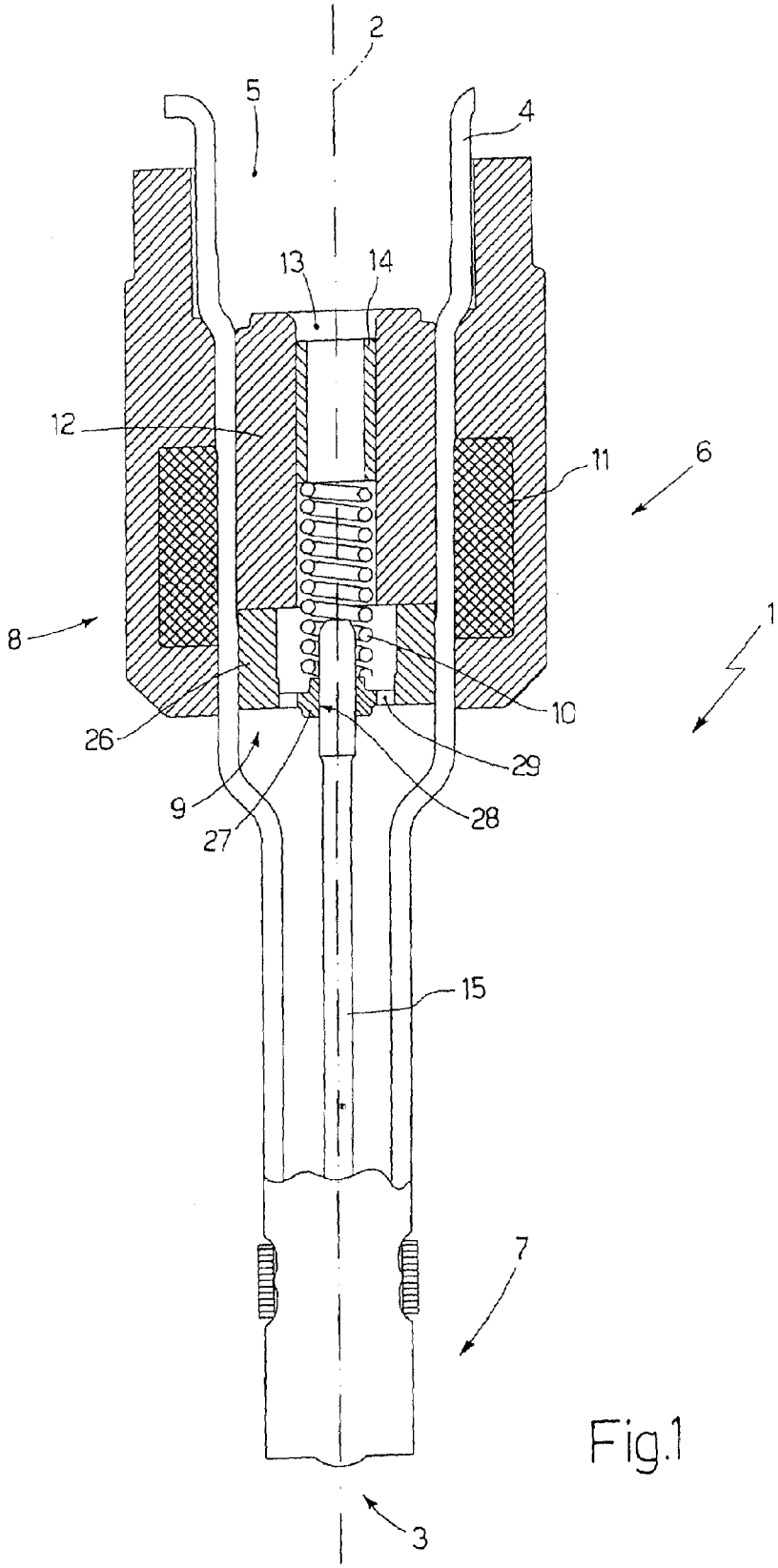
FIG. 1 is a schematic view, in side elevation and partially sectioned, of a fuel injector carried out according to the present invention.

In FIG. 1, number 1 indicates a fuel injector as a whole, which displays an essentially cylindrical symmetry around a longitudinal axis 2 and is adapted to be controlled to inject fuel from an injection nozzle 3 which leads directly into a combustion chamber (not shown) of a cylinder. Injector 1 comprises a supporting body 4, which has a cylindrical tubular shape having variable section along longitudinal axis 2 and displays a feeding channel 5 extending along the entire length of the supporting body 4 itself to feed pressurised fuel towards injection nozzle 3. Supporting body 4 accommodates an electromagnetic actuator 6 at an upper portion thereof and an injection valve 7 at a lower portion thereof; in use, injection valve 7 is actuated by electromagnetic actuator 6 to adjust the flow of fuel through injection nozzle 3, which is obtained at injection valve 7 itself.

Electromagnetic actuator 6 comprises an electromagnet 8, which is accommodated in fixed position within supporting body 4 and when energised is adapted to shift a ferromagnetic material keeper 9 along axis 2 from a closed position to an open position of injection valve 7 against the bias of a spring 10 which tends to hold keeper 9 in the closed position of injection valve 7. In particular, electromagnet 8 comprises a coil 11, which is electrically fed by a drive electronic unit (not shown) and is externally accommodated with respect to supporting body 4, and a magnetic armature, which is accommodated within supporting body 4 and displays a central hole 13 to allow the flow of fuel towards injection nozzle 3. A catching body 14 is driven in fixed position within central hole 13 of magnetic armature 12, such catching body displaying a tubular cylindrical shape (possibly open along a generating line) to allow the flow of fuel towards injection nozzle 3 and being adapted to hold spring 10 compressed against keeper 9.

Keeper 9 is part of a mobile equipment, which also comprises a shutter or needle 15, having an upper portion integral with keeper 9 and a lower portion cooperating with a valve seat 16 (shown in FIG. 2) of injection valve 7 to adjust the flow of fuel through injection nozzle 3 in the known way.

Figure 2:
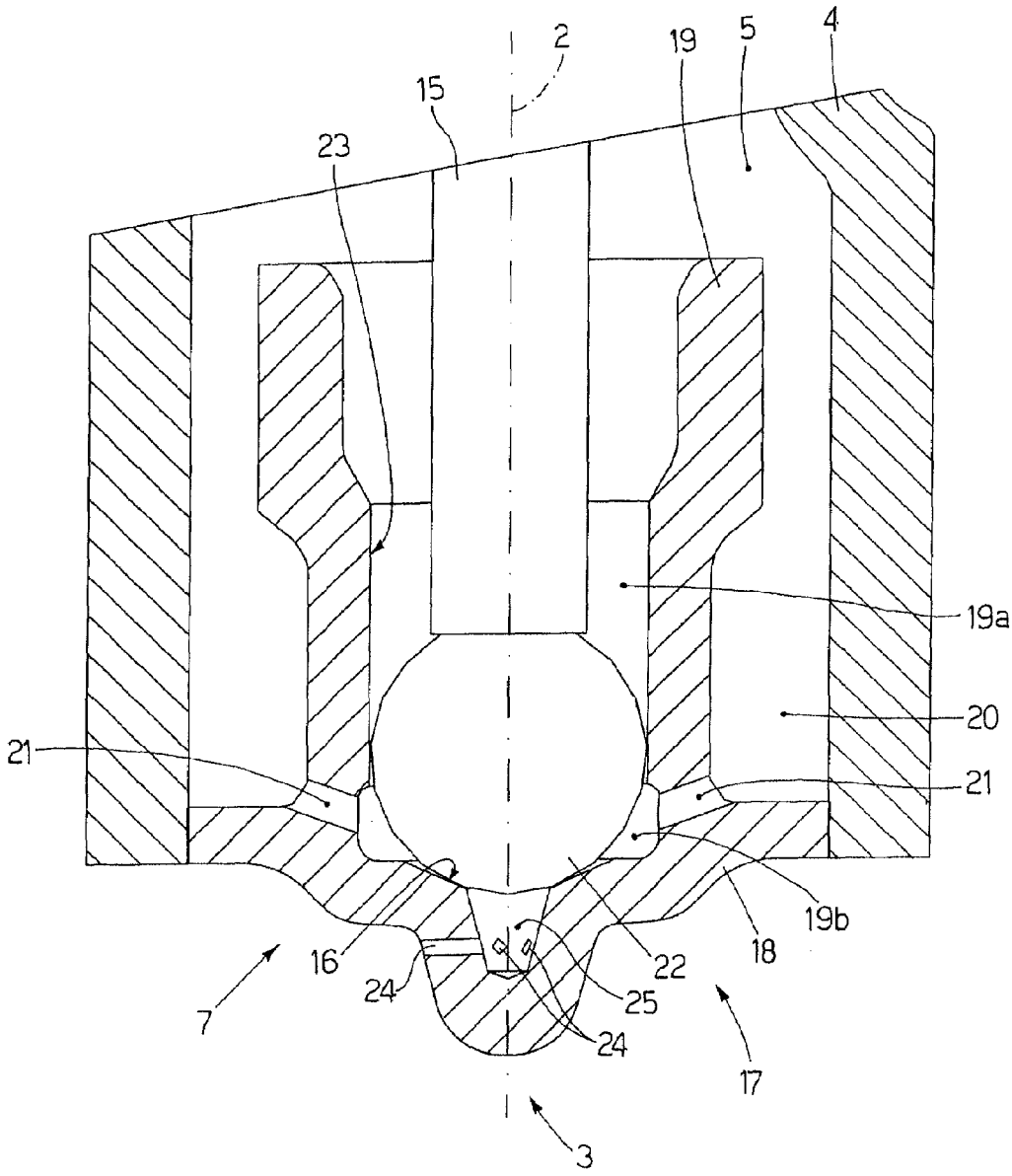
FIG. 2 shows an injection valve of a injector in FIG. 1 on a magnified scale.

As shown in FIG. 2, valve seat 16 is defined by a retaining body 17, which is monolithic and comprises a disc-shaped capping element 18, which lowerly and fluid-tightly closes feeding channel 5 of supporting body 4 and is crossed by injection nozzle 3. A guiding element 19 rises from capping element 18, such guiding element having a tubular shape, accommodating a needle 15 therein for defining a lower guide of the needle 15 itself and displaying an external diameter smaller than the internal diameter of feeding channel 5 of supporting body 4, so as to define an external annular channel 20 through which pressurised fuel may flow.

Four through feeding holes 21 (only two of which are shown in FIG. 2), which lead towards the valve seat to allow the flow of pressurised fuel towards the valve seat 16 itself, are obtained in the lower part of the guiding element 19. Feeding holes 21 may either be staggered with respect to a longitudinal axis 2 so as not to converge towards the longitudinal axis 2 itself and to impart in use a vortex flow to the respective fuel flows, or feeding holes 21 may converge towards longitudinal axis 2. As shown in FIG. 2, feeding holes 21 are arranged slanted by a 70° angle (more in general, from 60° to 80°) with longitudinal axis 2; according to a different embodiment (not shown), feeding holes 21 form a 90° angle with the longitudinal axis 2.

Needle 15 ends with an essentially spherical shutter head 22, which is adapted to fluid-tightly rest against valve seat 16; alternatively shutter head 22 may be essentially cylindrically shaped and have only a spherically shaped abutting zone. Furthermore, shutter head 22 sliding rests on an internal surface 23 of guiding element 19 so as to be guided in its movement along longitudinal axis 2. Injection nozzle 3 is defined by a plurality of through injection holes 24, which are obtained from an injection chamber 25 arranged downstream of the valve seat 16; for example, injection chamber 25 may have a semi-spherical shape, a truncated cone shape or also any other shape.

As shown in FIG. 1, keeper 9 is a monolithic element and comprises an annular element 26 and a discoid element 27, which lowerly closes annular element 26 and displays a central through hole 28 adapted to receive an upper portion of needle 15 and a plurality of peripheral through holes 29 (only two of which are shown in FIG. 3) adapted to allow the flow of fuel towards injection nozzle 3. A central portion of discoid element 27 is appropriately shaped, so as to accommodate and hold in position a lower end of spring 10. Preferably, needle 15 is integrally fixed to discoid element 27 of keeper 9 by means of an annular welding.

Annular element 26 of keeper 9 displays an external diameter essentially identical to the internal diameter of the corresponding portion of feeding channel 5 on supporting body 4; in this way, keeper 9 may slide with respect to supporting body 4 along longitudinal axis 2, but may not move transversally along longitudinal axis with respect to supporting body 4. Being needle 15 rigidly connected to keeper 9, it is clear that keeper 9 also functions as upper guide of needle 15; consequently, needle 15 is upperly guided by keeper 9 and lowerly guided by guiding element 19.

According to an alternative embodiment (not shown), an anti-rebound device is connected to the lower face of discoid element 27 of keeper 9, which is adapted to attenuate the rebound of shutter head 22 of needle 15 against valve seat 16 when needle 15 shifts from the open position to the closed position of injection valve 7.

In use, when electromagnet 8 is de-energised, keeper 9 is not attracted by magnetic armature 12 and the elastic force of spring 10 pushes keeper 9 downwards along with needle 15; in this situation, shutter head 22 of needle 15 is pressed against valve seat 16 of injection valve 7, isolating injection nozzle 3 from the pressurised fuel. When electromagnet 8 is energised, keeper 9 is magnetically attracted by armature 12 against the elastic bias of spring 10 and keeper 9 along with needle 15 is shifted upwards, coming into contact with the magnetic armature 12 itself; in this situation, shutter head 22 of needle 15 is raised with respect to valve seat 16 of injection valve 7 and the pressurised fuel may flow through injection nozzle 3.

As shown in FIG. 2, when shutter head 22 of needle 15 is raised with respect to valve seat 16, the fuel reaches injection chamber 25 of injection nozzle 3 through external annular channel 20 and then crosses the four feeding holes 21; in other words, when shutter head 22 is raised with respect to valve seat 16, the fuel reaches injection chamber 25 of injection nozzle 3 lapping on the entire external side surface of guiding element 19.

As shown in FIG. 2, when injection valve 7 is in closed position, shutter head 22 is pushed against valve seat 16; consequently, the pressurised fuel is present both within an upper portion 19*a* of guiding element 19, and within a lower portion 19*b* of guiding element 19 and the pressurised fuel is not present in injection chamber 25. In other words, an upper part of shutter head 22 arranged externally with respect to injection chamber 25 is in contact with the pressurised fuel, while a lower portion of shutter head 22 arranged within injection chamber 25 is not in contact with a pressurised fuel and is at a pressure equal to an ambient pressure $P_a$ present outside injection nozzle 3 (generally much lower than a fuel feeding pressure $P_c$). In this situation, an autoclave force $F_1$ (i.e. a force of hydraulic origin) is generated on shutter head 22 which tends to push shutter head 22 downwards and has an intensity provided by the following formula:

$$F_1=(P_c-P_a)*A_1$$

$F_1$ autoclave force;

$P_c$ fuel feeding pressure;

$P_a$ ambient pressure present outside the injection nozzle 3 and present also inside injection chamber 25 when injection valve 7 is in the closed position;

$A_1$ total area of the sealing zone of shutter head 22.

Obviously, autoclave force $F_1$ described above is cancelled out when injection valve 7 is driven to the open position in which shutter head 22 is raised with respect to valve seat 16 because in such a situation, the pressurised fuel is present also within injection chamber 25. From the above, it is apparent that electromagnet 8 in order to open injection valve 7, i.e. to shift shutter head 22 upwards, must generate a magnetic attraction force on keeper 9 sufficiently high to overcome both the elastic force generated by spring 10, and autoclave force $F_1$. Subsequently, in order to close injection valve 7, i.e. to shift shutter head 22 downwards, the magnetic attraction force acting on keeper 9 and generated by electromagnet 8 must drop to values lower than the elastic force generated by spring 10 only, because once injection valve 7 is open, autoclave force $F_1$ is cancelled out. Consequently, in the event of short injection times, the closing of injection valve 7 is slowed down, because in order to open injection valve 7 electromagnet 8 must overcome a total force considerably higher than the total force acting in closure by effect of autoclave pressure $F_1$ which is cancelled out once injection valve 7 is opened. In other words, the variation velocity of the magnetic attraction force generated by electromagnet 8 is limited by the inevitable magnetic inertia, therefore electromagnet 8 requires a certain time to decrease the magnetic attraction force needed for opening (equal at least to the elastic force generated by spring 10 added to autoclave force $F_1$) to the value needed for closure (lower than the elastic force generated by spring 10 alone).

Such slowdown during closure of injection valve 7 causes an initial step in the drive time-injected fuel quantity curve (i.e. the law which links the drive time to the quantity of injected fuel) of fuel injector 1 (i.e. such curve displays a step increase for short drive times and therefore for small quantities of injected fuel); furthermore, the entity of such initial step is higher proportionally to the fuel feeding pressure $P_c$.

In order to eliminate the above-described problem, it was observed that feeding holes 21 could be dimensioned so as to generate a further autoclave force $F_2$, which is generated only when injection valve 7 is open and essentially displays the same intensity and the same direction as autoclave force $F_1$. In this way, the elastic force generated by spring 10 and autoclave force $F_1$ act on shutter head 22 when injection valve 7 is closed, while the elastic force generated by spring 10 and the further autoclave force $F_2$ act on shutter head 22 when injection valve 7 is open; consequently, by opening injection valve 7, the total balance of the forces on shutter head 22 does not change, and the closing of injection valve 7 is not even slowed down for short injection times. Obviously, the more similar the further autoclave force $F_2$ is to autoclave force $F_1$, the better the positive effect.

Further autoclave force $F_2$ may be generated by creating an appropriate pressure differential between the fuel present in upper portion 19*a* of guiding element 19 and the fuel present in lower portion 19*b* of guiding element when injection valve 7 is in the open position. Such pressure differential may be induced by appropriately dimensioning feeding holes 21; indeed, by appropriately dimensioning feeding holes 21, feeding holes 21 cause an appropriate localised load loss (pressure drop) when the fuel flows through the feeding holes 21 themselves towards injection nozzle 3. It is important to underline that the load loss induced by feeding holes 21 is dynamic, i.e. is present only if the fuel is moving and flows at a certain speed through feeding holes 21 themselves and toward injection nozzle 3; consequently, the further autoclave force $F_2$ is present only when injection valve 7 is in the closed position.

The further autoclave force $F_2$ which tends to push shutter head 22 downwards has an intensity provided by the following formula:

$$F_2=(P_c-P_1)*A_2$$

$$P_1=P_c-\Delta P_{21}$$

$$F_2=\Delta P_{21}*A_2$$

$F_2$ further autoclave force;

$P_c$ feeding pressure of the fuel present in upper portion 19*a* of guiding element 19;

$P_1$ pressure of the fuel present in lower portion 19*b* of guiding element 19*a;*

$A_2$ total area of the contact zone between shutter head 22 and guiding element 19;

$\Delta P_{21}$ pressure drop determined by the loss of localised load through feeding holes 21.

It is important to underline that the formula described above for calculating intensity of further autoclave force $F_2$ is however approximate, because it ignores the localised pressure loss (localised load loss) due to the passage of fuel between shutter head 22 and valve seat 16. Such approximation is justified by the fact that the total area $A_2$ of the contact zone between shutter head 22 and guiding element 19 is much higher (indicatively 10 times higher) than the total area $A_1$ of the sealing zone of shutter head 22, therefore the total contribution of the localised pressure loss due to the passage of fuel between shutter head 22 and valve seat 16 is however reduced.

Assuming that the further autoclave force $F_2$ is identical to autoclave force $F_1$ ($F_1=F_2$) and supposing that ambient pressure $P_a$ outside injection nozzle 3 (and present within injection chamber 25 when injection valve 7 is in closed position) is null (i.e. negligible with respect to fuel feeding pressure $P_c$), it results:

$$F_1=P_c*A_1$$

$$F_2=\Delta P_{21}*A_2$$

$$P_c*A_1=\Delta P_{21}*A_2$$

$$\Delta P_{21}=P_c*A_1/A_2$$

Consequently, from fuel feeding pressure $P_c$, total area $A_1$ of the sealing zone of shutter head 22 and total area $A_2$ of the contact zone between shutter head 22 and guiding element 19, it is possible to calculate the pressure drop $\Delta P_{21}$ determined by the localised load loss through feeding holes 21 needed to balance autoclave forces $F_1$ and $F_2$. It is important to underline that fuel feeding pressure $P_c$, area $A_1$, and area $A_2$ are design data of injector 1, known beforehand and constant; furthermore, area $A_2$ is much larger (indicatively 10 times larger) than area $A_1$, therefore pressure drop $\Delta P_{21}$ will however be a contained fraction of fuel feeding pressure $P_c$.

In the case of cylindrical holes (i.e. such as feeding holes 21 or also injection holes 24 described above), the pressure drop may be calculated simply by applying the following formula (written for feeding holes 21 but easily adjustable for injection holes 24):

$$\Delta P_{21}=K_e*A_{21}\hat{}2$$

$\Delta P_{21}$ pressure drop determined by the localised load loss through feeding holes 21;

$K_e$ coefficient depending on the flow coefficients of feeding holes 21 and passage sections of the feeding holes 21 themselves;

$A_{21}$ sum of the passage section areas of fuel through feeding holes 21.

It is important to observe that in order to maintain an appropriate pressure differential between the fuel present in upper portion 19*a* of guiding element 19 and the fuel present in lower portion 19*b* of guiding element 19 it is important that shutter head 22 engages without appreciable clearance guiding element 19 so as to avoid leakage of fuel from upper portion 19*a* to lower portion 19*b*. The absence of appreciable clearance between shutter head 22 and guiding element 19 is also useful for the main function of guiding element 19 itself, i.e. to guide the movement of shutter head 22 along longitudinal axis 2.

A complex theoretical and experimental analysis of the behaviour of fuel injector 1 described above has led to the more precise and accurate determination of a further dimensioning formula of feeding holes 21 with respect to the dimensioning formula suggested above. In all cases, the initial hypothesis also at the base of the further dimensioning formula is that on shutter head 22 the sum of autoclave forces $F_1$ and $F_2$ is always constant.

The further dimensioning formula envisages that:

$$\Delta P_{24}/\Delta P_{21}=K*((D_2\hat{}2/D_1\hat{}2)-1)$$

$\Delta P_{21}$ pressure drop determined by localised load loss through feeding holes 21;

$\Delta P_{24}$ pressure drop determined by localised load loss through injection holes 24;

$D_1$ diameter of the sealing zone of shutter head 22;

$D_2$ diameter of the contact zone between shutter head 22 and guiding element 19;

K constant experimentally linked to the constructive features of fuel injector 1 (normally close to 1 and more generally from 0.7 to 1.3).

By way of example, two feeding holes 21 each with a diameter of 0.270 mm and a flow coefficient equal to 0.8 and five injection holes 24 each with a diameter of 0.120 mm and a flow coefficient equal to 0.722 were obtained in a marketed fuel injector 1 of the type described above; for this marketed fuel injector 1, it was calculated (and experimentally tested) that with a fuel feeding pressure $P_c$ equal to 800 bars, the autoclave force $F_1$ (fuel injector 1 closed) is equal to 48.74 N and the further autoclave force $F_2$ (fuel injector 1 open) is equal to 48.78 N.

Fuel injector 1 described above displays numerous advantages being easy and cost-effective to implement and displaying a linear and step-free drive time-injected fuel quantity curve (i.e. a law linking the drive time to the quantity of injected fuel), also for short drive times (i.e. for small quantities of injected fuel). Consequently, fuel injector 1 described above may be advantageously used also in a small direct injection internal combustion Diesel cycle engine (i.e. fed with Diesel fuel or the like).

It is important to underline that the only difference between the fuel injector 1 described above and a similar known fuel injector (e.g. of the type described in patent application EP1635055A1) is the particular dimensioning of the feeding holes 21; consequently, starting from a similar known fuel injector (e.g. of the type described in patent application EP1635055A1) the construction of the fuel injector 1 is particularly simple and cost effective.

The invention claimed is:

1. A fuel injector comprising:

an injection valve provided with a mobile needle to regulate the fuel flow;

an actuator adapted to shift the needle between a closed position and an open position of the injection valve;

an injection nozzle displaying a plurality of through injection holes formed from an injection chamber arranged downstream of injection valve;

a supporting body having a tubular shape and displaying a feeding channel;

a sealing body provided with a valve seat of the injection valve and comprising a disc-shaped capping element, which lowerly and fluid-tightly closes the feeding channel and is crossed by the injection nozzle, and a guiding element, which rises from the capping element, has a tubular shape, and accommodates the needle therein;

an external fuel guiding channel defined between the feeding channel and the guiding element which displays an external diameter smaller than the internal diameter of the feeding channel;

a number of through feeding holes made in the lower part of the guiding element and leading towards the valve seat; and a shutter head having an essentially spherical adjustment zone, which is integral with the needle, externally engages the guiding element and is adapted to fluid-tightly rest against the valve seat;

wherein the fuel injector is characterised in that the feeding holes are dimensioned so that the intensity of a first autoclave force ($F_1$) which is generated only when the injection valve is closed, is equal to a second autoclave force ($F_2$) which is generated only when the injection valve is open;

wherein the feeding holes are dimensioned so as to cause, when the fuel flows through the feeding holes themselves towards the injection nozzle, a localised pressure drop ($\Delta P$), the intensity of which is provided by the following formula:

$$\Delta P_{21}=P_c*A_1/A_2$$

$\Delta P_{21}$ localised pressure drop in the feeding holes;

$P_c$ fuel feeding pressure;

$A_1$ total area of the sealing zone of the shutter head;

$A_2$ total area of contact zone between the shutter head and the guiding element.

2. A fuel injector according to claim 1, wherein two feeding holes each with a diameter of 0.270 mm and five injection holes each with a diameter of 0.120 mm are present.

3. A fuel injector according to claim 1, wherein the shutter head engages the guiding element without appreciable clearance so as to avoid leakage of fuel from an upper portion to a lower portion of the guiding element itself.

4. A fuel injector according to claim 1, wherein the feeding holes of the guiding elements form with a longitudinal axis of the injector an angle from 60° to 80°.

5. A fuel injector according to claim 1, wherein the feeding holes form with a longitudinal axis of the injector an angle of 90°.

6. A fuel injector according to claim 1, wherein the feeding holes are staggered with respect to a longitudinal axis of the injector so as not to converge towards the longitudinal axis itself and to impart a vortex flow to the respective fuel flows.

7. A fuel injector according to claim 1, wherein the feeding holes converge towards a longitudinal axis of the injector.

8. A fuel injector according to claim 1, wherein the shutter head displays an essentially spherical shape.

9. A fuel injector according to claim 1, wherein the actuator comprises a spring, which holds the needle in the closed position.

10. A fuel injector according to claim 9, wherein the actuator is an electromagnetic actuator and comprises a coil, a fixed magnetic armature, and a keeper, which is magnetically attracted to the magnetic armature against the bias of the spring and is mechanically connected to the needle.

11. A fuel injector according to claim 10, wherein the keeper comprises an annular element and a discoid element, which lowerly closes the annular element and displays a central through hole adapted to receive an upper portion of the needle and a plurality of peripheral through holes adapted to allow the flow of fuel towards the injection nozzle.

12. A fuel injector comprising:

an injection valve provided with a mobile needle to regulate the fuel flow;

an actuator adapted to shift the needle between a closed position and an open position of the injection valve;

an injection nozzle displaying a plurality of through injection holes formed from an injection chamber arranged downstream of the injection valve;

a supporting body having a tubular shape and displaying a feeding channel;

a sealing body provided with a valve seat of the injection valve and comprising a disc-shaped capping element, which lowerly and fluid-tightly closes the feeding channel and is crossed by the injection nozzle, and a guiding element, which rises from the capping element, has a tubular shape, and accommodates the needle therein;

an external fuel guiding channel defined between the feeding channel and the guiding element which displays an external diameter smaller than the internal diameter of the feeding channel;

a number of through feeding holes made in the lower part of the guiding element and leading towards the valve seat; and a shutter head having an essentially spherical adjustment zone, which is integral with the needle, externally engages the guiding element and is adapted to fluid-tightly rest against the valve seat;

wherein the fuel injector is characterised in that the feeding holes are dimensioned so that the intensity of a first autoclave force ($F_1$) which is generated only when the injection valve is closed, is equal to a second autoclave force ($F_2$) which is generated only when the injection valve is open;

wherein the feeding holes are dimensioned according to the following formula:

$$\Delta P_{24}/\Delta P_{21}=K*((D_2\hat{}2/D_1\hat{}2)-1)$$

$\Delta P_{21}$ pressure drop determined by localised load loss through the feeding holes;

$\Delta P_{24}$ pressure drop determined by localised load loss through the injection holes;

$D_1$ diameter of the sealing zone of the shutter head;

$D_2$ diameter of the contact zone between the shutter head and the guiding element;

K experimental constant linked to the constructive features of the fuel injector.

* * * * *